US010811775B2

(12) United States Patent
Su

(10) Patent No.: US 10,811,775 B2
(45) **Date of Patent: *Oct. 20, 2020**

(54) LOOP ANTENNA

(71) Applicant: ASUSTeK COMPUTER INC., Taipei (TW)

(72) Inventor: Saou-Wen Su, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 18 days.

This patent is subject to a terminal disclaimer.

(21) Appl. No.: 16/244,299

(22) Filed: Jan. 10, 2019

(65) Prior Publication Data

US 2019/0288395 A1 Sep. 19, 2019

(30) Foreign Application Priority Data

Mar. 15, 2018 (TW) ..... 107108923 A

(51) Int. Cl.
*H01Q 1/22* (2006.01)
*H01Q 7/00* (2006.01)
*H01Q 5/328* (2015.01)

(52) U.S. Cl.
CPC ..... *H01Q 7/005* (2013.01); *H01Q 5/328* (2015.01)

(58) Field of Classification Search
CPC ..... H01Q 1/241–245; H01Q 1/2266; H01Q 7/005; H01Q 5/321; H01Q 5/378; H01Q 5/328; H01Q 9/42
See application file for complete search history.

(56) References Cited

U.S. PATENT DOCUMENTS 8,698,673 B2 4/2014 Wong et al.
9,407,003 B1 * 8/2016 Kruse ..... H01Q 1/242
(Continued)

FOREIGN PATENT DOCUMENTS

TW M241808 U 8/2004
TW I227576 B 2/2005
(Continued)

OTHER PUBLICATIONS

"Quarter-wavelength printed loop antenna for GSM/DCS/PCS/UMTS operation" 2008 Asia-Pacific Microwave Conference Year: 2008, pp. 1-4.

(Continued)

*Primary Examiner* — Awat M Salih
(74) *Attorney, Agent, or Firm* — McClure, Qualey & Rodack, LLP.

(57) ABSTRACT

The present disclosure provides a loop antenna, including a substrate, and a grounding portion, a radiating portion, a matching portion, and a feeding portion that are located on the substrate. The grounding portion includes a first grounding segment and a second grounding segment. The second grounding segment is perpendicular to the first grounding segment, and a first end of the second grounding segment is connected to a first end of the first grounding segment. The radiating portion includes a first radiating segment and a second radiating segment. The first radiating segment is connected to a second end of the first grounding segment and extending from the first grounding segment towards a direction away from the first grounding segment. The second radiating segment is connected to the first radiating segment and extending from the first radiating segment towards a direction facing the second grounding segment. The matching portion is located at an end of the second radiating segment close to the second grounding segment. The feeding (Continued)

portion is located between the end of the second radiating segment close to the second grounding segment, and is located between the matching portion and the second grounding segment to receive and transmit a feeding signal.

10 Claims, 7 Drawing Sheets

(56) References Cited

U.S. PATENT DOCUMENTS

2009/0184876 A1* 7/2009 Liu ..... H01Q 5/00 343/700 MS
2009/0262026 A1* 10/2009 Yu ..... H01Q 9/0442 343/700 MS
2011/0095952 A1* 4/2011 Lai ..... H01Q 9/42 343/749
2011/0102283 A1* 5/2011 Chang ..... H01Q 7/00 343/749
2011/0128200 A1* 6/2011 Hossain ..... H01Q 9/14 343/745
2012/0274536 A1* 11/2012 Pan ..... H01Q 1/38 343/853
2013/0106670 A1* 5/2013 Pan ..... H01Q 5/35 343/843
2013/0241777 A1* 9/2013 Chang ..... H01Q 1/243 343/700 MS
2014/0333494 A1* 11/2014 Huang ..... H01Q 1/002 343/720
2016/0079656 A1* 3/2016 Tsai ..... H01Q 1/243 343/750
2016/0294060 A1* 10/2016 Meng ..... H01Q 1/243

FOREIGN PATENT DOCUMENTS

TW I293215 B 2/2008
TW 200933975 A 8/2009
TW 200943624 A 10/2009
TW 200952256 A 12/2009
TW I414104 B 11/2013
TW I423526 B 1/2014

OTHER PUBLICATIONS

Office Action issued in corresponding Taiwan patent application dated Mar. 13, 2019.

* cited by examiner

LOOP ANTENNA

CROSS-REFERENCE TO RELATED APPLICATION

This application claims the priority benefit of Taiwan application Ser. No. 107108923, filed on Mar. 15, 2018. The entirety of the above-mentioned patent application is hereby incorporated by reference herein and made a part of the specification.

BACKGROUND OF THE INVENTION

Field of the Invention

The present disclosure relates to an antenna element, and particularly, to a loop antenna.

Description of the Related Art

Built-in antennas, such as dipole antennas, planar inverted-F antennas (PIFA), or loop antennas, are generally applied to mobile devices such as notebook computers, tablet computers, or mobile phones, and particular antenna space needs to be reserved in internal space of the devices.

However, as characteristics such as lightness, thinness, and portability of the mobile devices as well as aesthetics and texture of products are required in industrial design, metal or conductive materials are generally used for appearance design. Radiation performance of the antennas obviously degrades due to insufficient antenna space or clearance areas, but sufficient clearance areas result in an increase in the thickness of the devices. Consequently, antenna design is confronted with severe environment challenges due to the foregoing requirements.

BRIEF SUMMARY OF THE INVENTION

According to one aspect of the disclosure, a loop antenna is provided. The loop antenna includes a substrate, and a grounding portion, a radiating portion, a matching portion, and a feeding portion that are located on the substrate. The grounding portion includes a first grounding segment and a second grounding segment. The second grounding segment is perpendicular to the first grounding segment, and a first end of the second grounding segment is connected to a first end of the first grounding segment. The radiating portion includes a first radiating segment and a second radiating segment. The first radiating segment is connected to a second end of the first grounding segment and extending from the first grounding segment towards a direction away from the first grounding segment. The second radiating segment is connected to the first radiating segment and extending from the first radiating segment towards a direction facing the second grounding segment. The matching portion is located at an end of the second radiating segment close to the second grounding segment. The feeding portion is located between the end of the second radiating segment close to the second grounding segment, and is located between the matching portion and the second grounding segment. The feeding portion is configured to receive and transmit a feeding signal from a signal source.

DETAILED DESCRIPTION OF THE EMBODIMENTS

Figure 1:
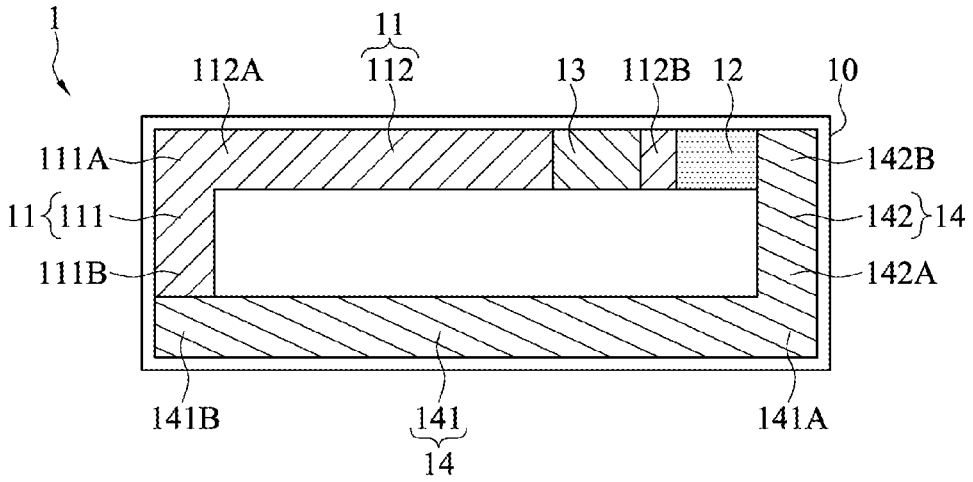
FIG. 1 is a schematic diagram of an embodiment of a loop antenna according to the present disclosure.

FIG. 1 is a schematic diagram of an embodiment of a loop antenna 1 according to the present disclosure. The loop antenna 1 has lower-frequency and higher-frequency resonant modes. Referring to FIG. 1, the loop antenna 1 includes a substrate 10, and a radiating portion 11, a matching portion 13, and a grounding portion 14 that are located on the substrate 10. The radiating portion 11, the grounding portion 14, and the feeding portion 12 are made of conductive materials (for example, copper, silver, iron, or aluminum, or an alloy thereof), and the radiating portion 11 and the grounding portion 14 are printed on the substrate 10.

The grounding portion 14 is configured to provide signal grounding, and the grounding portion 14 is connected to a system ground plane of an electronic device having the loop antenna 1. The grounding portion 14 includes a first grounding segment 141 and a second grounding segment 142. A first end 142A of the second grounding segment 142 is connected to a first end 141A of the first grounding segment 141, and the first grounding segment 141 is perpendicular to the second grounding segment 142 (where for example, a length direction of the first grounding segment 141 is perpendicular to a length direction of the second grounding segment 142). The first grounding segment 141 and the second grounding segment 142 are of an inverted-L shape.

The radiating portion 11 includes a first radiating segment 111 and a second radiating segment 112. A second end 111B of the first radiating segment 111 is connected to a second end 141B of the first grounding segment 141, the first radiating segment 111 is extending from the first grounding segment 141 towards a direction away from the first grounding segment 141, and a first end 111A of the first radiating segment 111 is connected to a first end 112A of the second radiating segment 112. The second radiating segment 112 extends from the first radiating segment 111 towards a direction facing the second grounding segment 142 of the grounding portion 14.

The matching portion 13 is located at an end (that is, a second end 112B) of the second radiating segment 112 close to the second grounding segment 142. The matching portion 13 is implemented using a passive element, and the matching portion 13 excites the loop antenna 1 to generate a resonant mode of less than or equal to 0.25 wavelength at the lower-frequency.

Figure 2:
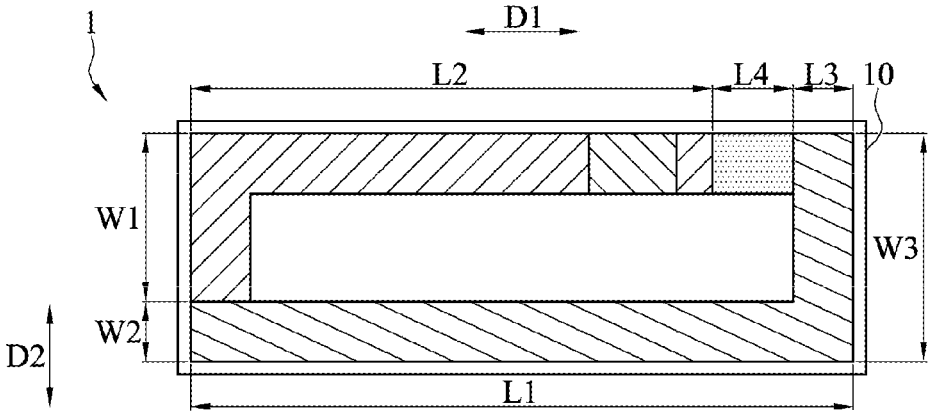
FIG. 2 is a schematic diagram of a size of the loop antenna in FIG. 1.

The feeding portion 12 is located between the second end 112B of the second radiating segment 112 and the second grounding segment 142, and the feeding portion 12 is located between the matching portion 13 and the second grounding segment 142. The feeding portion 12 is configured to receive or transmit a feeding signal from a signal source and form a closed current resonant path between the radiating portion 11 and the grounding portion 14. Therefore, when the feeding signal is fed from the feeding portion 12, the loop antenna 1 generates the resonant mode of less than or equal to 0.25 wavelength at the lower-frequency by the matching portion 13. The loop antenna 1 is capable of operating in a lower-frequency band (0.25 wavelength) and a higher frequency band (0.5 wavelength), thereby satisfying a requirement of a current electronic communication device. In addition, in an embodiment, referring to FIG. 2, the loop antenna 1 has a length direction D1 and a width direction D2. A length L2 of the radiating portion 11 in the length direction D1 ranges between 16.5 mm and 17.5 mm, and a line width W1 of the radiating portion 11 in the width direction D2 ranges between 3 mm and 4 mm. A length L1 of the first grounding segment 141 in the length direction D1 is 20 mm, and a line width W2 of the first grounding segment 141 in the width direction D2 ranges between 1 mm and 2 mm. A length L3 of the second grounding segment 142 in the length direction D1 is 2 mm, and a line width W3 of the second grounding segment 142 in the width direction D2 is 5 mm. A length L4 of the feeding portion 12 in the length direction D1 is 0.5 mm. Based on the foregoing, an overall length of the loop antenna 1 in the length direction D1 is 20 mm, and an overall width of the loop antenna 1 in the width direction D2 is 5 mm (where a sum of the line width W2 of the first grounding segment 141 in the width direction D2 and the line width W1 of the radiating portion 11 in the width direction D2 does not exceed 5 mm). That is, an overall size of the loop antenna 1 is 20 mm×5 mm (that is, 100 $mm^2$). The size of the loop antenna 1 satisfies a requirement on an electronic device having a narrow bezel (for example, a narrow bezel of 5 mm to 7 mm width).

Figure 3:
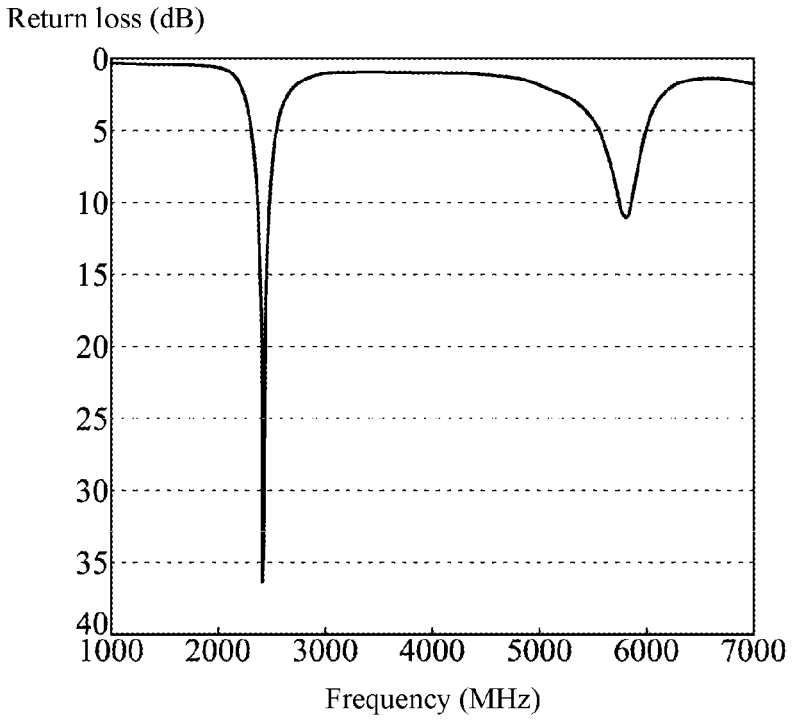
FIG. 3 is a diagram of return loss of an embodiment of a loop antenna at each operating frequency according to the present disclosure.
Figure 4A:
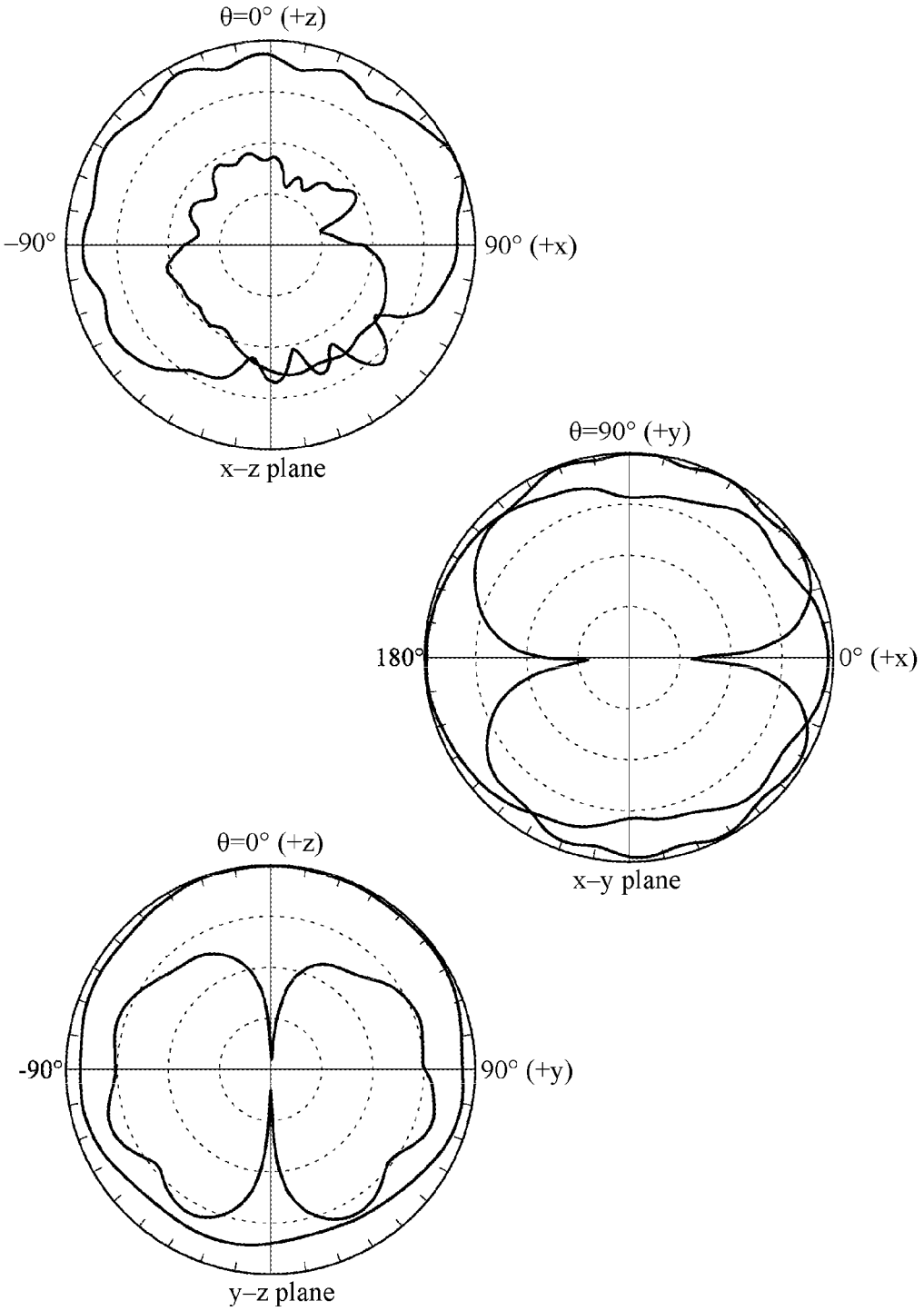
FIG. 4A is radiation patterns of an embodiment of a loop antenna operated at 2.4 GHz according to the present disclosure.
Figure 4B:
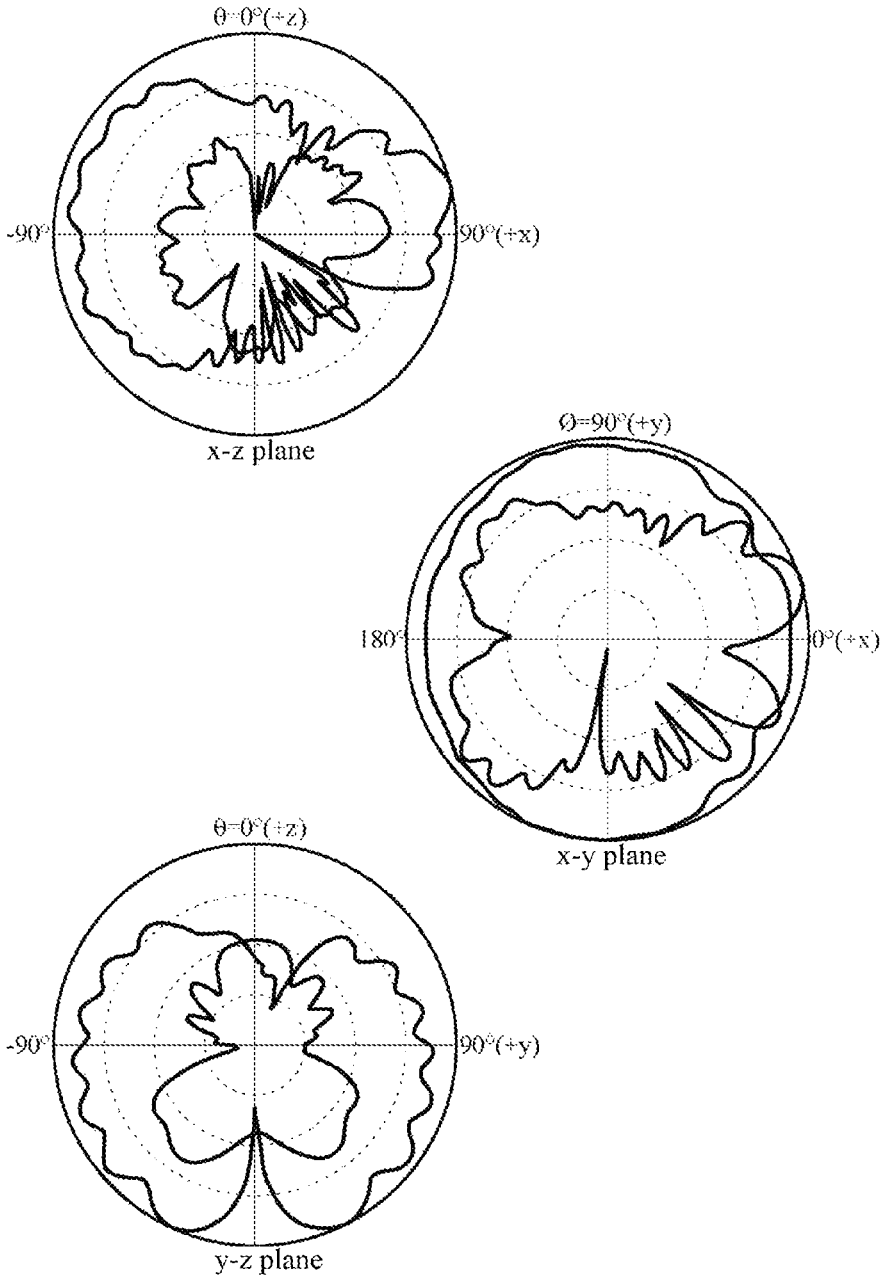
FIG. 4B is a radiation pattern of an embodiment of a loop antenna operated at 5.8 GHz according to the present disclosure.

Based on the foregoing size and structure of the loop antenna 1, the lower-frequency band in which the loop antenna 1 is capable of operating covers the 2.4 GHz band, and the higher-frequency band in which the loop antenna 1 is capable of operating covers the 5.8 GHz band. Referring to FIG. 3, FIG. 3 is a diagram of return loss of an embodiment of the loop antenna 1 at each operating frequency according to the present disclosure. It is learned in FIG. 3 that the lower-frequency band and the higher-frequency band in which the loop antenna 1 is capable of operating respectively cover the 2.4 GHz and 5.8 GHz bands. Further, referring to FIG. 4A and FIG. 4B, FIG. 4A and FIG. 4B are respectively radiation patterns of the loop antenna 1 operating in the frequency bands of 2.4 GHz and 5.8 GHz. It is learned from pattern distribution shown in FIG. 4A and FIG. 4B that when the loop antenna 1 is operating at 2.4 GHz and 5.8 GHz, an antenna gain in each direction is desirable.

In an embodiment, as shown in FIG. 1, the first radiating segment 111 is perpendicular to the second radiating segment 112 (that is, a length direction of the first radiating segment 111 is perpendicular to a length direction of the second radiating segment 112). That is, the first radiating segment 111 and the second radiating segment 112 forms an inverted-L shape, and the inverted L-shape of the first grounding segment 141, the second grounding segment 142, the feeding portion 12, and the matching portion 13 form the closed current path. In addition, the second radiating segment 112 is parallel to the first grounding segment 141 and is perpendicular to the second grounding segment 142, and the first radiating segment 111 is parallel to the second grounding segment 142 and is perpendicular to the first grounding segment 141.

Figure 5:
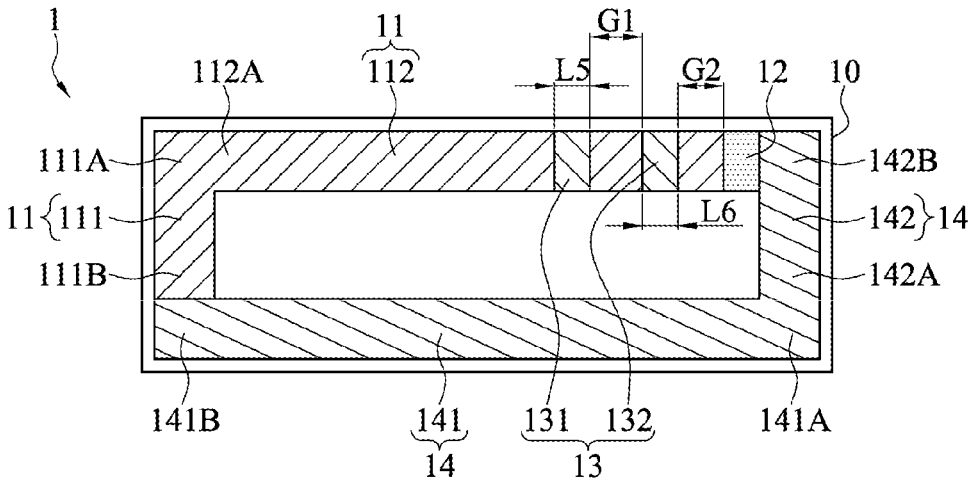
FIG. 5 is a schematic diagram of an embodiment of a matching portion of a loop antenna according to the present disclosure.

In an embodiment, the matching portion 13 includes a chip capacitor, to excite the lower-frequency resonant mode of the loop antenna 1 by the chip capacitor. In an embodiment, the matching portion 13 includes two matching elements disposed at an interval. FIG. 5 is a schematic diagram of an embodiment of the matching portion 13 of the loop antenna 1 according to the present disclosure. As shown in FIG. 5, the matching portion 13 includes matching elements 131 and 132 disposed at an interval. The matching element 132 is located between the matching element 131 and the feeding portion 12, and the matching element 132 is closer to the feeding portion 12 than the matching element 131. The matching elements 131 and 132 are respectively a chip inductor and a chip capacitor. An inductance value of the matching element 131 ranges between 4.2 nH and 5.3 nH, and a capacitance value of the matching element 132 ranges between 0.1 pF and 0.3 pF. Further, lengths L5 and L6 of the matching elements 131 and 132 in the length direction D1 are 0.6 mm, and an interval G1 between the matching elements 131 and 132 and an interval G2 between the matching element 132 and the feeding portion 12 are 1 mm.

Figure 6:
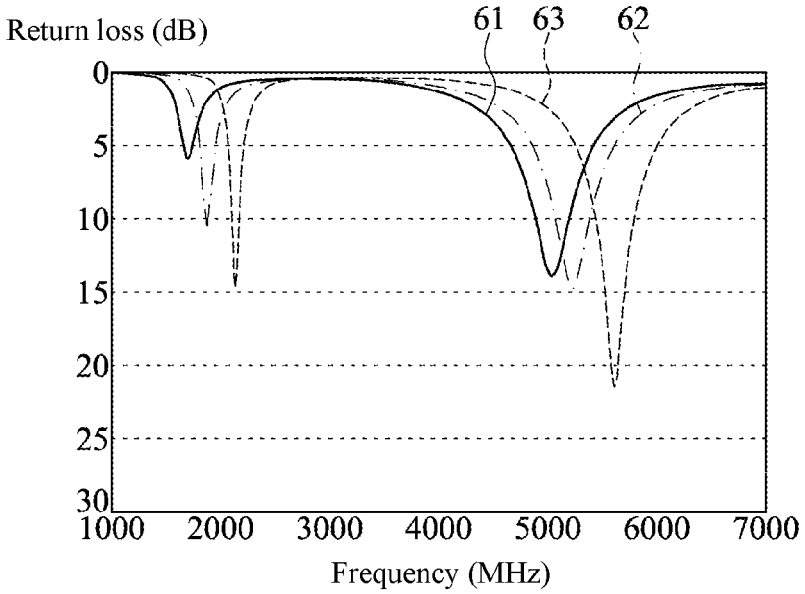
FIG. 6 is a diagram of return loss of the loop antenna in FIG. 5.
Figure 7:
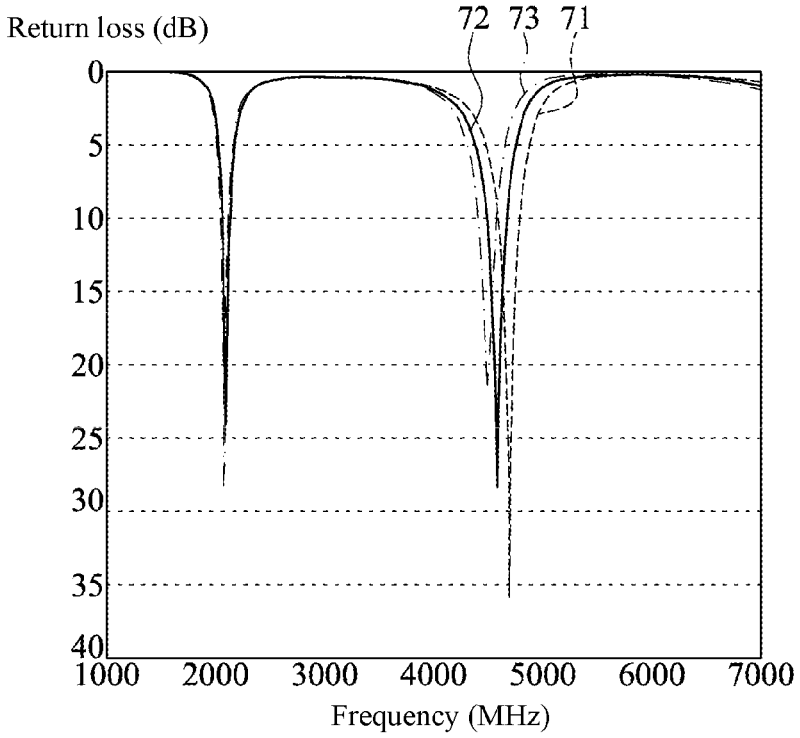
FIG. 7 is another diagram of return loss of the loop antenna in FIG. 5.

Based on the foregoing, the matching element 132 is capable of exciting the lower-frequency resonant mode of the loop antenna 1, and the matching element 131 is capable of controlling an operating frequency of the loop antenna 1 in the higher-frequency resonant mode, so that the operating frequencies of the loop antenna 1 respectively cover the 2.4 GHz and 5.8 GHz bands. Referring to FIG. 6 and FIG. 7, FIG. 6 and FIG. 7 are respectively a diagram of return loss of the loop antenna 1 including the matching element 132 having a different capacitance value at each operating frequency and a diagram of return loss of the loop antenna 1 including the matching element 131 having a different inductance value at each operating frequency. Return loss curves 61, 62, and 63 respectively correspond to the loop antenna 1 including the matching element 131 having capacitance values 0.3 pF, 0.2 pF, and 0.1 pF, and return loss curves 71, 72, and 73 respectively correspond to the loop antenna 1 including the matching element 131 having inductance values 4.2 nH, 4.8 nH, and 5.3 nH. It is learned in FIG. 6 that a larger capacitance value of the matching element 132 indicates a lower operating frequency of the loop antenna 1 in the lower-frequency resonant mode. It is learned in FIG. 7 that a smaller inductance value of the matching element 131 indicates a higher operating frequency of the loop antenna 1 in the higher-frequency resonant mode.

Figure 8:
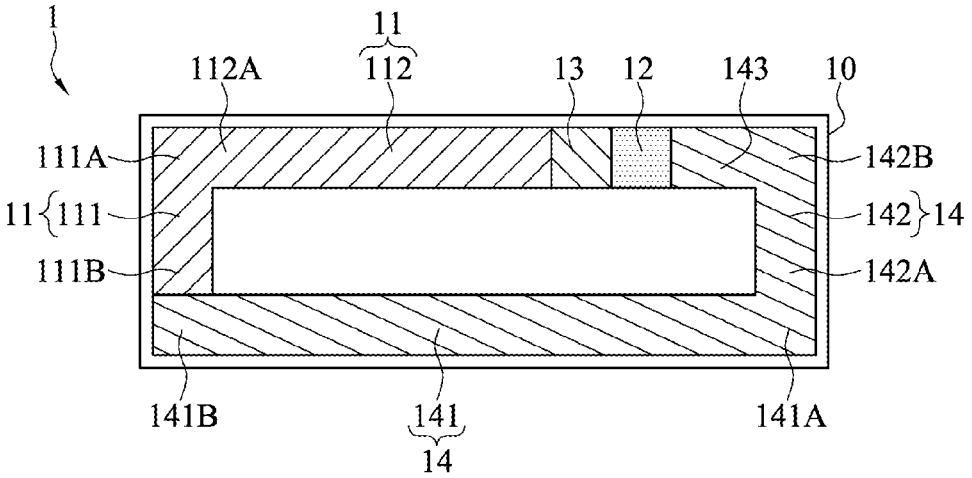
FIG. 8 is a schematic diagram of another embodiment of a loop antenna according to the present disclosure.

FIG. 8 is a schematic diagram of another embodiment of a loop antenna according to the present disclosure. Referring to FIG. 8, the grounding portion 14 further includes a third grounding segment 143 in addition to the first grounding segment 141 and the second grounding segment 142. The third grounding segment 143 is connected to the second grounding segment 142, and the third grounding segment 143 is extending from the second grounding segment 142 towards a direction facing the second radiating segment 112. Herein, in this embodiment, the feeding portion 12 is located between the matching portion 13 and the third grounding segment 143. The loop antenna 1 shown in FIG. 8 also has lower-frequency and higher-frequency resonant modes.

Figure 9:
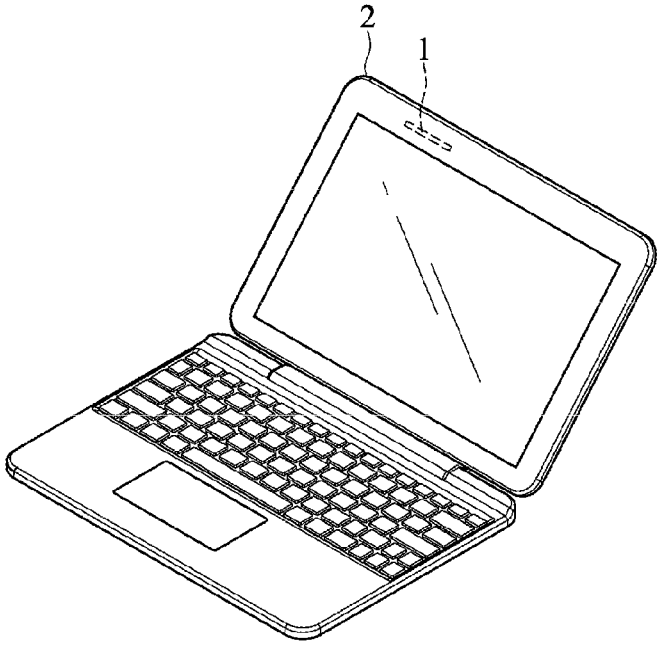
FIG. 9 is a schematic diagram of an embodiment of a loop antenna applied to an electronic device according to the present disclosure.

FIG. 9 is a schematic diagram of an embodiment of a loop antenna applied to an electronic device 2 according to the present disclosure. Herein, a notebook computer is used as an example of the electronic device 2 shown in FIG. 9, but the present disclosure is not thereto. The electronic device 2 is alternatively a tablet computer or an all-in-one (AiO) computer. As described above, the size of the loop antenna 1 is 5 mm×20 mm, and the loop antenna 1 is disposed in a narrow bezel around a screen of the electronic device 2, to satisfy a requirement on a current electronic device having a narrow bezel.

In conclusion, according to an embodiment of the loop antenna of the present disclosure, the low-frequency resonant mode of the loop antenna is further excited by using the matching portion, so that the loop antenna is capable of operating in at least two frequency bands: the low frequency and the high frequency. In addition, the size of the loop antenna is 5 mm×20 mm, satisfying a requirement on an existing electronic device having a narrow bezel.

Although the present disclosure is disclosed above by using the embodiments, the embodiments are not intended to limit the present disclosure. A person of ordinary skill in the art can make some variations and polishes without departing from the spirit and scope of the present disclosure. Therefore, the protection scope of the present disclosure should be subject to the scope of the following claims.

What is claimed is:

1. A loop antenna, comprising:

a substrate;

a grounding portion, located on the substrate, and comprising:

a first grounding segment; and a second grounding segment, perpendicular to the first grounding segment, wherein a first end of the second grounding segment is connected to a first end of the first grounding segment;

a radiating portion, located on the substrate, and comprising:

a first radiating segment, connected to a second end of the first grounding segment and extending from the first grounding segment towards a direction away from the first grounding segment, and the first radiating segment directly contacts the first grounding segment; and a second radiating segment, connected to the first radiating segment and extending from the first radiating segment towards a direction facing the second grounding segment;

a matching portion, located on the substrate and located at an end of the second radiating segment close to the second grounding segment; and a feeding portion, located between the matching portion and the second grounding segment, and the feeding portion directly contacts the grounding portion, wherein the feeding portion is configured to receive or transmit a feeding signal from a signal source;

wherein the first radiating segment, the second radiating segment, the first grounding segment, the second grounding segment, the feeding portion, and the matching portion form a continuous closed current path.

2. The loop antenna according to claim 1, wherein the grounding portion further comprises a third grounding segment, the third grounding segment is connected to the second grounding segment and extending from the second grounding segment towards a direction facing the second radiating segment, and the feeding portion is located between the third grounding segment and the second radiating segment.

3. The loop antenna according to claim 1, wherein the matching portion comprises two matching elements disposed at an interval.

4. The loop antenna according to claim 3, wherein the two matching elements are respectively an inductance element and a capacitance element.

5. The loop antenna according to claim 4, wherein the capacitance element is located between the inductance element and the feeding portion.

6. The loop antenna according to claim 5, wherein there is an interval between the capacitance element and the feeding portion.

7. The loop antenna according to claim 5, wherein an inductance value of the inductance element ranges between 4.2 nH and 5.3 nH, and a capacitance value of the capacitance element ranges between 0.1 pF and 0.3 pF.

8. The loop antenna according to claim 5, wherein an interval between the inductance element and the capacitance element is 1 mm.

9. The loop antenna according to claim 1, wherein the matching portion comprises a capacitance element.

10. The loop antenna according to claim 1, having a length direction and a width direction, wherein a sum of a line width of the first grounding segment in the width direction and a line width of the first radiating segment in the width direction does not exceed 5 mm.

* * * * *